US009096081B2

(12) United States Patent
Katagami

(10) Patent No.: US 9,096,081 B2
(45) Date of Patent: Aug. 4, 2015

(54) IMAGE RECORDING DEVICE AND IMAGE RECORDING METHOD

(71) Applicant: SEIKO EPSON CORPORATION, Tokyo (JP)

(72) Inventor: Satoru Katagami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 13/847,540

(22) Filed: Mar. 20, 2013

(65) Prior Publication Data

US 2013/0258014 A1 Oct. 3, 2013

(30) Foreign Application Priority Data

Mar. 21, 2012 (JP) ..... 2012-063777

(51) Int. Cl.

| | |
|---|---|
| ***B41J 2/01*** | (2006.01) |
| ***B41J 29/38*** | (2006.01) |
| ***B41J 11/00*** | (2006.01) |
| ***B41J 15/16*** | (2006.01) |

(52) U.S. Cl.

CPC ..... *B41J 11/007* (2013.01); *B41J 11/002* (2013.01); *B41J 11/0015* (2013.01); *B41J 15/16* (2013.01)

(58) Field of Classification Search

USPC ..... 347/102, 16, 101, 104, 105, 106, 4

See application file for complete search history.

(56) References Cited

U.S. PATENT DOCUMENTS

| | | | | |
|---|---|---|---|---|
| 3,503,859 | A * | 3/1970 | Corbett et al. | 204/165 |
| 3,532,054 | A * | 10/1970 | Lloyd et al. | 347/112 |
| 4,308,542 | A * | 12/1981 | Maekawa et al. | 347/102 |
| 4,836,901 | A * | 6/1989 | Manabe et al. | 204/164 |
| 5,900,218 | A * | 5/1999 | LaRose et al. | 422/186.04 |
| 6,048,060 | A * | 4/2000 | Narushima et al. | 347/104 |
| 6,049,680 | A * | 4/2000 | Goris et al. | 399/44 |
| 6,436,191 | B1 * | 8/2002 | Stewart et al. | 118/620 |
| 6,922,544 | B2 * | 7/2005 | Ide | 399/390 |
| 2001/0028381 | A1 * | 10/2001 | Kashiwagi et al. | 347/104 |
| 2002/0027586 | A1 * | 3/2002 | Kikuchi et al. | 347/104 |
| 2004/0114019 | A1 * | 6/2004 | Nakashima | 347/104 |
| 2005/0041059 | A1 * | 2/2005 | Nakashima et al. | 347/29 |

(Continued)

FOREIGN PATENT DOCUMENTS

| | | | |
|---|---|---|---|
| JP | 02286274 | A * | 11/1990 |
| JP | 2009-292129 | A | 12/2009 |
| JP | 2011-194797 | A | 10/2011 |

*Primary Examiner* — Julian Huffman
*Assistant Examiner* — Leonard S Liang
(74) *Attorney, Agent, or Firm* — Global IP Counselors, LLP

(57) ABSTRACT

An image recording device includes a support member, a recording head, a conveyor unit, a surface modifying apparatus and a movement mechanism. The conveyor unit intermittently conveys a recording medium toward a support member along a conveyance path, and intermittently passes the recording medium through a processing position disposed on an upstream side of the supporting member with respect to the conveyance path. The surface modifying apparatus, during a passage time in which the recording medium passes through the processing position, executes surface modification processing on the recording medium passing through the processing position, and emits heat along with execution of the surface modification process. The movement mechanism places the recording medium passing through the processing position near the surface modifying apparatus during the processing time, and separates the recording medium and the surface modifying apparatus when the passage time ends.

5 Claims, 5 Drawing Sheets

(56) References Cited

U.S. PATENT DOCUMENTS

| | | | | |
|---|---|---|---|---|
| 2006/0077232 | A1* | 4/2006 | Nakazawa | 347/55 |
| 2006/0082604 | A1* | 4/2006 | Florence et al. | 347/5 |
| 2006/0191426 | A1* | 8/2006 | Timmerman et al. | 101/24 |
| 2007/0002115 | A1* | 1/2007 | Nakazawa | 347/102 |
| 2009/0074463 | A1* | 3/2009 | Nishio et al. | 399/170 |
| 2011/0050824 | A1 | 3/2011 | Toya et al. | |
| 2013/0113869 | A1* | 5/2013 | Kobayashi et al. | 347/104 |
| 2014/0028769 | A1* | 1/2014 | Fletcher et al. | 347/104 |
| 2014/0049586 | A1* | 2/2014 | Fletcher et al. | 347/103 |
| 2014/0070464 | A1* | 3/2014 | Lin et al. | 264/448 |
| 2014/0125748 | A1* | 5/2014 | Fletcher et al. | 347/104 |

* cited by examiner

IMAGE RECORDING DEVICE AND IMAGE RECORDING METHOD

CROSS-REFERENCE TO RELATED APPLICATIONS

This application claims priority to Japanese Patent Application No. 2012-063777 filed on Mar. 21, 2012. The entire disclosure of Japanese Patent Application No. 2012-063777 is hereby incorporated herein by reference.

BACKGROUND

1. Technical Field

The present invention relates to technology for recording images by, while intermittently conveying a recording medium, ejecting a liquid on the recording medium when stopped, and specifically relates to technology for executing surface modification processing on a recording medium prior to the liquid being ejected on the recording medium.

2. Related Art

In Japanese Laid-Open Patent Application Publication No. 2011-194797 is noted an image recording device with which a recording head ejects ink on a recording medium supported on a platen to print an image on the recording medium. Specifically with this image recording device, the recording medium is intermittently conveyed over the platen, and the recording head records an image on the recording medium while it is stopped over the platen. In this way, the recording head ejects ink to record an image on the recording medium that is being sequentially conveyed over the platen.

SUMMARY

However, with the aforementioned device that ejects a liquid such as ink on a recording medium to record an image, having the liquid be securely adhered to the recording medium is important. In light of that, it is conceivable to use a surface modifying apparatus such as a corona treater to execute surface modification processing on the recording medium. In specific terms, it is sufficient to arrange the surface modifying apparatus at the upstream side of the recording head in the recording medium conveyance path, and to execute surface modification processing on the recording medium that passes in front of the surface modifying apparatus as the recording medium is being conveyed. By doing this, the recording medium which has undergone surface modification processing is supplied to the recording head, and it is possible to increase the adhesive properties of the liquid ejected by the recording head onto the recording medium.

However, when using this kind of constitution, there was the risk of the problem of the recording medium degrading due to heat emission of the surface modifying apparatus. Specifically, the surface modifying apparatus emits heat along with execution of the surface modification processing. At that time, when the heat of the surface modifying apparatus is conducted to the recording medium, there were times when the recording medium degraded. In particular, with a constitution in which conveyance of the recording medium is performed intermittently as described above, the recording medium stops between repeatedly executed conveyances. Because of that, when the surface modifying apparatus is close to the stopped recording medium for a long period, the heat degradation of the recording medium becomes marked, and there was the risk of affecting the quality of the image recorded on the recording medium.

The present invention was created considering the problems noted above, and an object is to provide technology that makes it possible to suppress degradation of the recording medium due to the heat of the surface modifying apparatus and to realize high quality image recording.

An image recording device according to one aspect includes a support member, a recording head, a conveyor unit, a surface modifying apparatus and a movement mechanism. The support member is configured and arranged to support a recording medium conveyed along a conveyance path. The recording head is configured and arranged to eject a liquid on the recording medium while stopped above the support member to record an image. The conveyor unit is configured and arranged to intermittently convey the recording medium toward the support member along the conveyance path, and to intermittently pass the recording medium through a processing position disposed on an upstream side of the supporting member with respect to the conveyance path by intermittently conveying the recording medium to the processing position along the conveyance path. The surface modifying apparatus is configured and arranged to, during a passage time in which the recording medium passes through the processing position, execute surface modification processing on the recording medium passing through the processing position, and to emit heat along with execution of the surface modification process. The movement mechanism is configured and arranged to place the recording medium passing through the processing position near the surface modifying apparatus during the processing time, and to separate the recording medium and the surface modifying apparatus when the passage time ends.

An image recording method according to another aspect is a method for ejecting a liquid on a recording medium while stopped above a support member to record an image while the recording medium is being conveyed along a conveyance path. The image recording method includes: intermittently conveying the recording medium toward the support member along the conveyance path, and intermittently passing the recording medium through a processing position disposed on an upstream side of the supporting member with respect to the conveyance path by intermittently conveying the recording medium to the processing position along the conveyance path; and during a passage time in which the recording medium passes through the processing position, executing surface modification processing on the recording medium passing through the processing position using a surface modifying apparatus that emits heat along with execution of the surface modification processing. The executing of the surface modification processing includes placing the recording medium passing through the processing position near the surface modifying apparatus during the processing time, and executing a separation operation which separates the recording medium and the surface modifying apparatus when the passage time ends.

With the aspects constituted in this way (image recording device, and image recording method), the recording medium is intermittently passed through the processing position, and also, during the passage time in which the recording medium passes through the processing position, the surface modifying apparatus executes surface modification processing on the recording medium that passes through the processing position. Also, with this aspect, a constitution is provided by which the surface modifying apparatus and the recording medium are put close to each other and separated. In specific terms, during the passage time, the recording medium passing through the processing position and the surface modifying apparatus are put close to each other, and it is possible to execute surface modification processing on the recording medium passing through the processing position. Meanwhile, when the passage time ends, the separation operation of separating the recording medium and the surface modifying apparatus is executed. In other words, when the passage time ends, and the intermittent conveyance of the recording medium to the processing position stops, the recording medium and the surface modifying apparatus are separated. Therefore, heat conduction to the recording medium from the surface modifying apparatus that is heated along with execution of the surface modification processing is inhibited. As a result, degradation of the recording medium due to the heat of the surface modifying apparatus is suppressed, and it is possible to execute high quality image recording.

Various items can be used for the specific constitution for executing the separation operation of separating the recording medium and the surface modifying apparatus. In light of that, for example, the image recording device can be constituted such that the movement mechanism has a winding roller for winding up the recording medium from the opposite side of the surface modifying apparatus sandwiching the recording medium, and during the passage time, while placing the recording medium near the surface modifying apparatus by having the winding roller face opposite the surface modifying apparatus at the processing position, executes the separation operation by separating the winding roller from the surface modifying apparatus when the passage time ends.

The image recording device can also be constituted such that the conveyor unit executes at different timings the operation of doing intermittent conveyance of the recording medium to the support member, and the operation of intermittently passing the recording medium through the processing position. With such a constitution, it is possible to respectively execute at appropriate timings the operation of intermittently conveying the recording medium to the support member, and the operation of intermittently passing the recording medium through the processing position.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
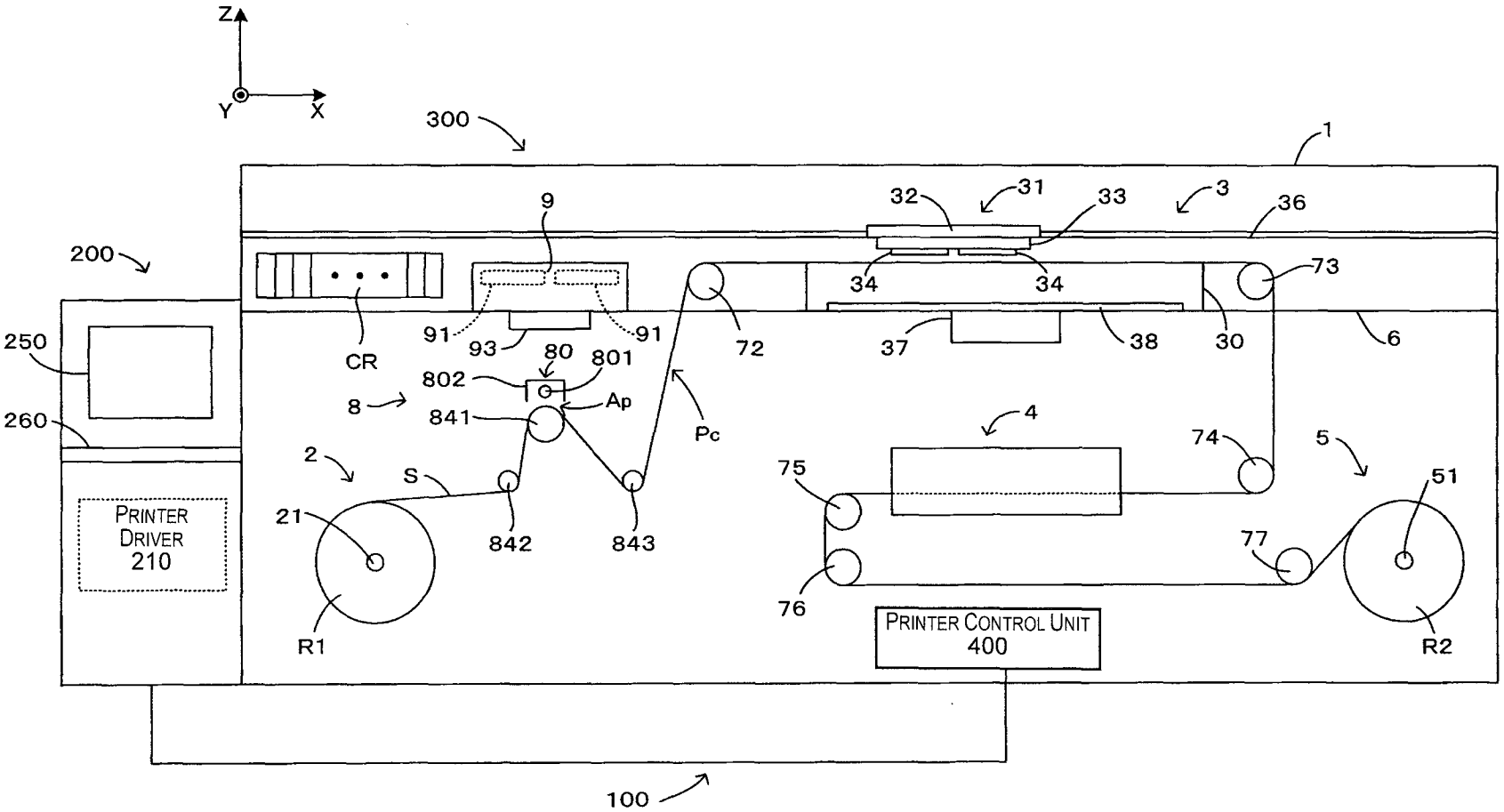
FIG. 1 is a pattern diagram showing an example of a printing system to which the present invention can be applied.

FIG. 1 is a pattern diagram showing an example of a printing system to which the present invention can be applied. Note that in FIG. 1 and the drawings thereafter, when necessary to clarify the arrangement relationship of each unit of the device, the X, Y, and Z orthogonal coordinates having the Z axis as the perpendicular axis are noted together. With the description below, the direction in which each coordinate axis (arrow) faces is the positive direction, and the opposite facing direction is the negative direction, and the Z axis positive side is handled as appropriate as the upper side, and the Z axis negative side as the lower side.

The printing system 100 is equipped with a host device 200 for generating printing data based on image data received from an external device such as a personal computer or the like, and a printer 300 for printing images based on the printing data received from the host device 200. This printer 300 prints an image (forms an image) using the inkjet method on a sheet S while conveying one long sheet S (web) for which both ends are wound in a roll form using the roll-to-roll method.

As shown in FIG. 1, the printer 300 is equipped with a main unit case 1 having a generally rectangular solid shape. Arranged inside the main unit case 1 are an outlet shaft 2 that lets out the sheet S from the roll R1 on which the sheet S is wound, a printing chamber 3 for ejecting ink on the outlet sheet S to perform printing, a drying unit 4 for drying the sheet S on which ink has adhered, and a rewind unit 5 that rewinds the sheet S after drying as a roll R2.

More specifically, the inside of the main unit case 1 is segmented vertically in the Z axis direction by a plate shaped base 6 arranged in parallel to the XY plane (specifically, horizontally), and the upper side of the base 6 is the printing chamber 3. At roughly the center part within the printing chamber 3, a platen 30 is fixed on the top surface of the base 6. The platen 30 has a rectangular shape, and the sheet S is supported from the lower side by the top surface that is parallel to the XY plane. Also, a recording unit 31 performs printing on the sheet S supported on the platen 30.

Meanwhile, the outlet unit 2, the drying unit 4, and the rewind unit 5 are arranged at the lower side of the base 6. The outlet unit 2 is arranged at the lower side (lower left diagonally in FIG. 1) of the X axis negative direction in relation to the platen 30, and is equipped with a freely rotating outlet shaft 21. Also, the sheet S is wound in roll form on this outlet shaft 21, and the roll R1 is supported on it. Meanwhile, the rewind unit 5 is arranged at the lower side of the X axis positive direction (lower right diagonally in FIG. 1) in relation to the platen 30, and is equipped with a freely rotating rewind shaft 51. Also, the sheet S is wound in roll form on the rewind shaft 51, and the roll R2 is supported on it. Also, the drying unit 4 is arranged directly under the platen 30 between the outlet unit 2 and the rewind unit 5 in the X axis direction. The drying unit 4 is slightly to the upper side in relation to the outlet unit 2 and the rewind unit 5.

Then, the sheet S is conveyed along a conveyance path Pc facing the rewind unit 5 from the outlet unit 2, and it passes through the printing chamber 3 and the drying unit 4 in sequence. In specific terms, the sheet S let out from the outlet shaft 21 that the outlet unit 2 is equipped with is guided to the printing chamber 3 via a corona treatment unit 8 described later. In the interior of this printing chamber 3 are aligned in sequence two rollers 72 and 73 in the X axis positive direction of the sheet S. Then, the sheet S guided inside the printing chamber 3 is wound onto these two rollers 72 and 73. The rollers 72 and 73 are arranged aligned straight in the X axis direction (specifically, horizontally) so as to sandwich the platen 30, and the respective apexes have their position adjusted so as to have the same height as the top surface of the platen 30 (surface supporting the sheet S). Therefore, the sheet S wound onto the roller 72 moves horizontally (in the X axis direction) while sliding in contact on the top surface of the platen 30 until it reaches the roller 73. Then, the sheet S rolled onto the roller 73 is guided downward.

At the lower side of the roller 73 (lower side from the base 6), two rollers 74 and 75 are aligned in sequence in the X axis negative direction. The sheet S wound onto the roller 74 and the roller 75 is guided in parallel to the X axis direction (specifically, horizontally) between both rollers 74 and 75.

Also, the drying unit 4 is arranged between the rollers 74 and 75. Therefore, the sheet S wound onto the roller 74 changes direction to the X axis negative direction, and also passes through the interior of the drying unit 4 until it reaches the roller 75. At the lower side of the roller 75, two rollers 76 and 77 are aligned in sequence in the X axis positive direction. Then, the sheet S wound onto the roller 76 changes direction to the X axis positive direction and reaches the roller 77. Also, the sheet S wound onto the roller 77 is rewound onto the rewind shaft 51 of the rewind unit 5 arranged in the X axis positive direction of the roller 77.

In this way, the sheet S outlet from the outlet unit 2 passes through the printing chamber 3 and the drying unit 4, and is rewound onto the rewind unit 5. Then, various types of processing such as print processing at the printing chamber 3, drying processing by the drying unit 4 and the like are implemented on this sheet S.

The printing process in the printing chamber 3 is executed by a recording unit 31 arranged at the upper side of the platen 30. This recording unit 31 ejects ink, which is supplied by an ink supply mechanism (not illustrated) from an ink cartridge CR arranged at the X axis negative direction end part (left end part in FIG. 1), onto the sheet S using an inkjet method to perform printing. In specific terms, this recording unit 31 is equipped with a carriage 32, a plate shaped support plate 33 attached to the bottom surface of the carriage 32, and a plurality of recording heads 34 attached to the bottom surface of the support plate 33.

Figure 2:
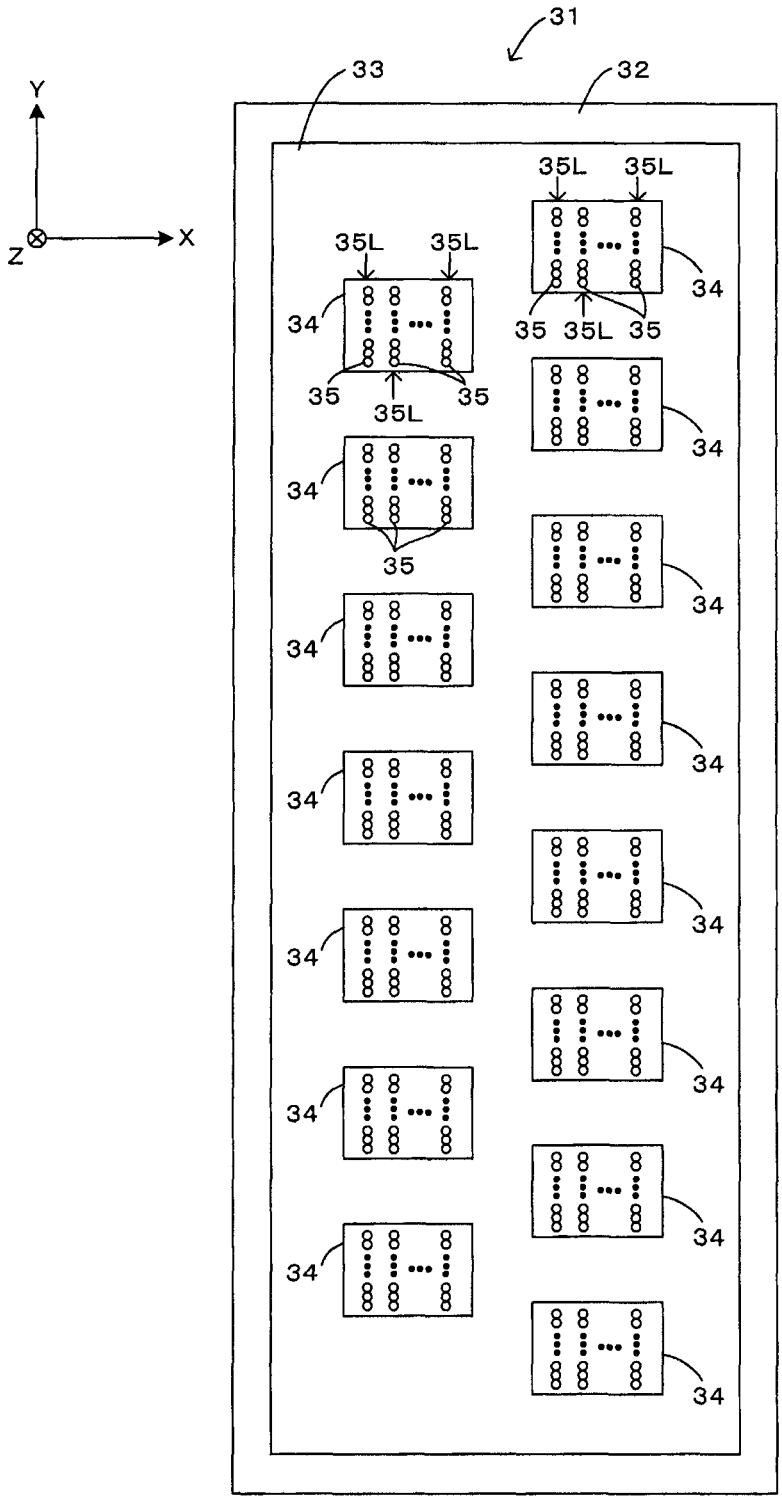
FIG. 2 is a plan view partially showing the constitution of the recording unit.

FIG. 2 is a plan view partially showing the constitution of the recording unit. As shown in FIG. 2, at the bottom surface of the support plate 33, 15 recording heads 34 are aligned in two zigzag rows at an equal pitch in the Y axis direction. These recording heads 34 eject ink from nozzles 35 and are equipped with the same constitutions as each other. In light of that, hereafter, we will give a detailed description of the constitution of one recording head 34 as a representative example.

At the bottom surface of the recording head 34, one nozzle row 35L is constituted by a plurality of (e.g. 180) nozzles 35 aligned in a straight line at equal pitch in the Y axis direction constitute, and a plurality of nozzle rows 35L are aligned at an equal pitch in the X axis direction. The plurality of nozzle rows 35L aligned on the bottom surface of the recording head 34 correspond to mutually different ink colors, and for example when using eight colors of ink, eight rows of nozzle rows 35L are aligned on the bottom surface of the recording head 34. Then, the nozzles 35 belonging to the same nozzle row 35L eject mutually the same color, and meanwhile, the nozzles 35 belonging to different nozzle rows 35L eject mutually different colored inks. Note that the nozzles 35 use the piezo method of ejecting ink outside a tube by applying voltage to a piezo element attached to a micro tube in which ink is clogged to cause deformation.

We will return to FIG. 1 to continue the description. With the carriage 32 of the recording unit 31 constituted as described above, the support plate 33 and the recording head 34 move freely as an integrated unit. In specific terms, a first guide rail 36 extending in the X axis direction is provided inside the printing chamber 3, and when the carriage 32 receives the drive force of the first CR motor Mx (FIG. 3), it moves in the X axis direction along the first guide rail 36. Furthermore, a second guide rail (not illustrated) extending in the Y axis direction is provided inside the printing chamber 3, and when the carriage 32 receives the drive force of a second CR motor My (FIG. 3), it moves in the Y axis direction along the second guide rail.

Then, the carriage 32 of the recording unit 31 is moved two dimensionally within the XY plane in relation to the sheet S which has stopped on the top surface of the platen 30, and printing is executed. In specific terms, with the recording unit 31, while the carriage 32 is being moved in the X axis direction (main scan direction), the operation of ejecting ink on the sheet S (main scan) from the nozzles 35 of the recording head 34 is executed. With this main scan, a plurality of single line images (line images) extending in the X axis direction formed from the ink ejected from one nozzle are aligned with gaps open in the Y axis direction, and a two dimensional image is printed. Then, this main scan and a sub scan by which the carriage 32 moves in the Y axis direction (sub scan direction) are executed alternately, and the main scan is executed a plurality of times (lateral scan method).

In other words, when one main scan is completed, the recording unit 31 performs a sub scan and moves the carriage 32 in the Y axis direction. Subsequently, from the position to which it was moved by this sub scan, the recording unit 31 moves the carriage 32 in the X axis direction (the direction opposite to the previous main scan). By doing this, a line image by the new main scan is formed between the respective plurality of line images already formed by the previous main scan. Then, the main scan and the sub scan are executed alternately. In other words, with this printer 300, ink is ejected from the nozzles 35 while the carriage 32 is moved in the X axis direction, and while changing position in the Y axis direction (sub scan), by the operation of forming the interim generated image consisting of a plurality of line images (main scan) being executed a plurality of times, an image with which the interim generated images are overlapped is formed.

By executing the main scan a plurality of times in this way, one printing is executed. Here, one main scan is called a "pass," and one printing executed by a plurality of passes is called a "frame." Also, the interim generated image formed on the sheet S with one pass is called "one pass image."

The reason for repeatedly alternately performing this kind of main scan and sub scan is to improve the resolution. In other words, by executing passes M times, and overlapping a count of M one pass images, it is possible to obtain one frame amount of an image having M times the resolution of the one pass image. In light of that, the recording unit 31 executes a number of passes according to the resolution of the image to be printed to execute one frame of printing. Incidentally, the carriage 32 can move back and forth in the X axis direction. In light of that, the recording unit 31 executes a plurality of passes efficiently by executing the respective passes of the carriage 32 back and forth.

One frame of printing as described above is repeatedly executed while intermittently moving the sheet S in the X axis direction. In specific terms, a predetermined range across almost the entire area of the top surface of the platen 30 is the printing area. Then, with the distance corresponding to the length in the X axis direction of this printing area (intermittent conveyance distance) as a unit, the sheet S is intermittently conveyed in the X axis direction, and one frame of printing is performed on the sheet S that is stopped on the top surface of the platen 30 during intermittent conveyance. To say this in specific terms, when printing of one frame on the sheet S stopped on the platen 30 has ended, the sheet S is conveyed in the X axis direction by the intermittent conveyance distance, and the unprinted surface of the sheet S stops on the platen 30. Subsequently, one frame of printing is newly executed on this unprinted surface, and when that is completed, the sheet S is again conveyed in the X axis direction by the intermittent conveyance distance. Then, this series of operations is executed repeatedly.

To keep the sheet S that is stopped on the top surface of the platen 30 flat during intermittent conveyance, the platen 30 is equipped with a mechanism for suctioning the sheet S that is stopped on the top surface. In specific terms, a large number of vacuum holes (not illustrated) are opened on the top surface of the platen 30, and a suction unit 37 is attached to the lower surface of the platen 30. Then, by the suction unit 37 operating, negative pressure is generated in the vacuum holes on the top surface of the platen 30, and the sheet S is suctioned to the top surface of the platen 30. Then, the suction unit 37 keeps the sheet S flat by suctioning the sheet S while the sheet S is stopped over the platen 30 for printing, and when printing ends, stops suctioning of the sheet S, so it is possible to convey the sheet S smoothly.

Furthermore, a heater 38 is attached to the lower surface of the platen 30. This heater 38 heats the platen 30 to a prescribed temperature (e.g. 45 degrees). By doing this, the sheet S undergoes primary drying by the heat of the platen 30 in parallel with undergoing the printing process from the recording head 34. Then, by this primary drying, drying of the ink impacted on the sheet S is promoted.

In this way, on the top surface of the platen 30, the sheet S that undergoes one frame of printing as well as primary drying is moved along with intermittent conveyance of the sheet S to a drying unit 4. This drying unit 4 executes heat processing by drying the ink impacted on the sheet S completely using air heated for drying. Then, the sheet S which has undergone this drying processing reaches a rewind unit 5 along with intermittent conveyance of the sheet S, and is wound as a roll R2.

Working as noted above, printing and drying processing are implemented on the sheet S by the recording unit 31 and the drying unit 4. In addition to the recording unit 31 and the drying unit 4 described above, the printer 300 is also equipped with functional units of a corona treatment unit 8 and a maintenance unit 9. Following, we will give a detailed description of the constitution and operation of these.

Figure 3:
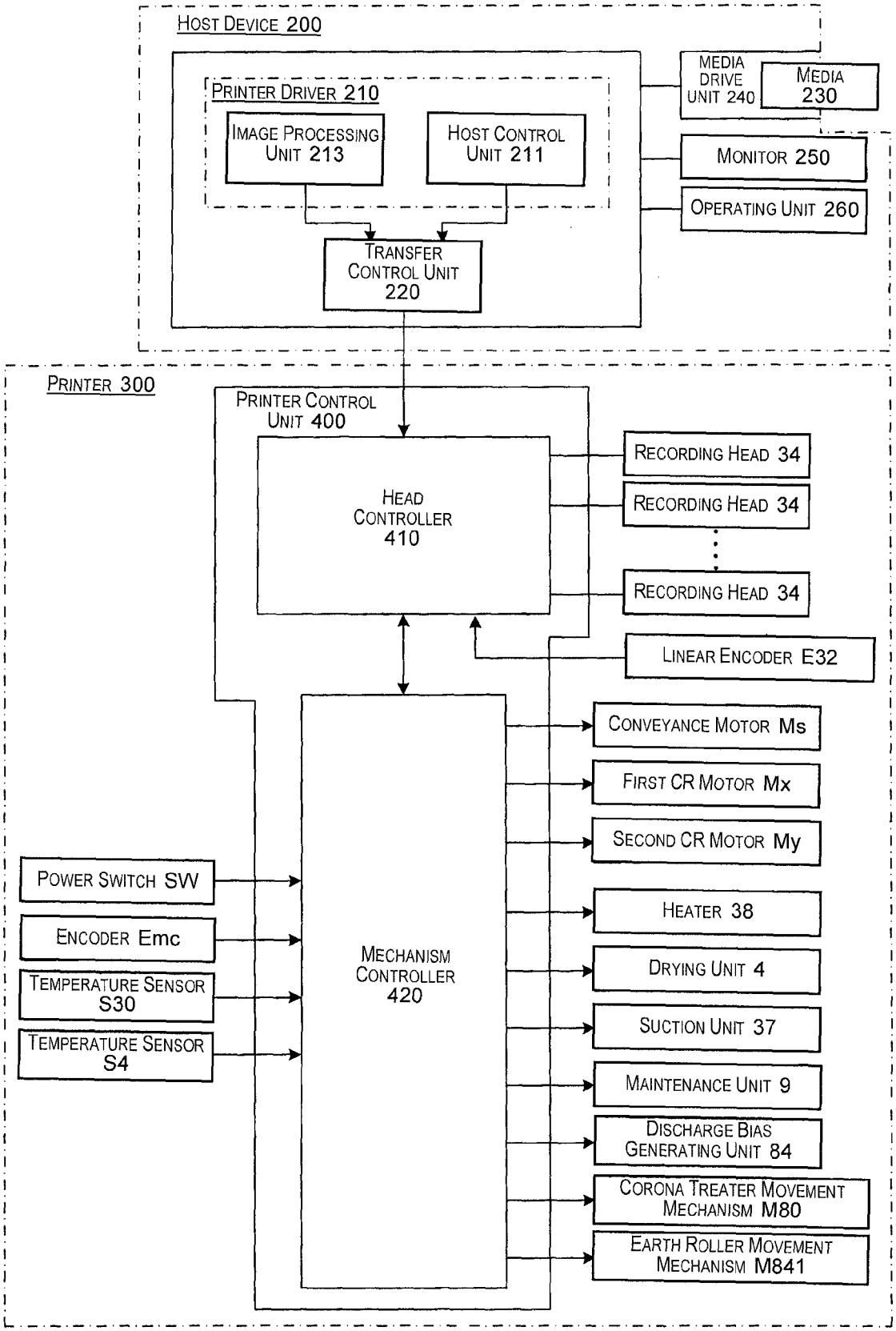
FIG. 3 is a block diagram typically showing the electrical configuration provided with the printing system of FIG. 1.

The corona treatment unit 8 is arranged between roll R1 of the outlet shaft 21 and roller 72 (platen 30) in the conveyance path Pc, and has a corona treater 80. This corona treater 80 has a corona discharge electrode 801 facing opposite the surface of the sheet S, and an electrode cover 802 covering the corona discharge electrode 801. Furthermore, in addition to the corona treater 80, the corona treatment unit 8 has an earth roller 841 facing opposite the corona treater 80 with the sheet wound from the back surface, and rollers 842 and 843 that roll the front surface of the sheet S are on the upstream and downstream sides of the earth roller 841. As described later, the corona treater 80 and the earth roller 841 are constituted so as to be able to be moved by movement mechanisms M80 and M841 (FIG. 3).

Then, while the corona discharge electrode 801 is connected to a discharge bias generator 84 (FIG. 3), the earth roller 841 is grounded. Therefore, when discharge bias is applied to the corona discharge electrode 801 from the discharge bias generator 84, a corona discharge is generated between the corona discharge electrode 801 and the earth roller 841. As a result, at the processing position Ap facing opposite the corona treater 80 (said another way, the position at which it is wound onto the earth roller 841), the sheet S undergoes corona treatment (surface modification processing). By doing this, energy is given to the surface of the sheet S by the corona discharge, the surface of the sheet S is modified, and the wetting properties of the sheet S for the ink are improved. Then, the sheet S which has undergone that corona treatment is supplied to the platen 30, and undergoes printing processing by the recording unit 31. Incidentally, the corona treater 80 equipped with this kind of constitution has the property of heating along with execution of corona treatment.

The maintenance unit 9 is provided at a position away from the X axis negative direction from the platen 30, and performs maintenance on the recording head 34 that is evacuated in a home position (position directly above the maintenance unit) when not printing. This maintenance unit 9 has 15 caps 91 provided with a one-to-one correlation to the 15 recording heads 34, and a raising and lowering unit 93 that raises and lowers the caps 91.

As the maintenance executed by this maintenance unit 9, there is capping, cleaning, and wiping. Capping is a process of raising the caps 91 using the raising and lowering unit 93, and covering the recording heads 34 in the home position with the caps 91. By doing this capping, it is possible to suppress an increase in viscosity of the ink within the nozzles 35 that the recording head 34 has. Also, cleaning is a process of forcefully ejecting ink from the nozzles 35 by generating negative pressure within the caps 91 with the recording heads 34 in a capped state. By doing this cleaning, it is possible to remove ink for which the viscosity has increased, air bubbles in the ink and the like from the nozzles 35. Wiping is a process of using a wiper (not illustrated) to wipe the surface on which the nozzle 35 openings are aligned on the recording head 34 (nozzle opening formation surface). By doing this wiping, it is possible to wipe away ink from the nozzle opening formation surface of the recording head 34.

Above was a summary of the device constitution which the printing system 100 is equipped with. Following, we will add FIG. 3 to FIG. 1 described above and give a detailed description of the electrical constitution that the printing system of FIG. 1 is equipped with. Here, FIG. 3 is a block diagram typically showing the electrical constitution that the printing system of FIG. 1 is equipped with.

As described above, in addition to the printer 300, the printing system 100 is also equipped with a host device 200 that controls this. This host device 200 is constituted by a personal host computer, for example, and in addition to incorporating a printer driver 210 that controls the operation of the printer 300, is also equipped with a transfer control unit 220 that is in charge of the communication function with the printer 300. The printer driver 210 is built by the CPU (Central Processing Unit) that the host device 200 is equipped with executing a program for the printer driver 210.

Also, the host device 200 is equipped with a media driving unit 240 that accesses media 230 in which the printer driver program is stored, and reads that program. As this media 230, it is possible to use various media such as a CD (Compact Disc), DVD (Digital Versatile Disc), USB (Universal Serial Bus) memory or the like.

Furthermore, as an interface with the operator, the host device 200 is equipped with a monitor 250 constituted by a liquid crystal display or the like, and an operating unit 260 constituted by a keyboard, mouse or the like. It is also possible to use a touch panel display as the monitor 250, and to constitute the operating unit 260 with this monitor 250 touch panel. In addition to an image of the printing subject, a menu screen is also displayed on the monitor 250. Therefore, by the operator operating the operating unit 260 while confirming the monitor 250, it is possible to open the print setting screen from the menu screen, and to set various types of printing conditions such as type of print media, print media size, print quality, number of impressions and the like.

The type of print media (specifically, sheet S) is roughly divided into paper and film types. To give specific examples, for the paper type, there is high quality paper, cast paper, art paper, coated paper and the like, and for the film type, there is synthetic paper, PET (Polyethylene terephthalate), PP (polypropylene) and the like. As the print media size, the width of sheet S (width in the Y axis direction) is set. The print quality can be set by selecting one printing mode from the plurality of print modes prepared according to the resolution to be printed. Following are some examples. Specifically, with the aforementioned printer 30, it is possible to change the resolution by changing the pass count executed for one frame. In light of that, it is possible to prepare a plurality of print modes for which the pass count executed with one frame is different, and to make it possible to select a print mode of the pass count according to the resolution to print. By doing this, it is possible to execute printing at the resolution according to the pass count of the selected print mode. It is also possible to constitute this to set the print quality by direct input of the resolution instead of the print mode. The number of impressions is set when printing a plurality of impressions (images) overlapping on the same area of the print media, and the number of impressions to be printed overlapping is set. Incidentally, it is possible to display an image for each impression on the monitor 250 when a plurality of impressions is set.

Then, the printer driver 210 is equipped with the monitor 250 display like that described above, or a host control unit 211 for controlling processing of input from the operating unit 260. In other words, the host control unit 211 displays various types of screens such as the menu screen, print setting screen and the like on the monitor 250, and performs processing on the various screens according to the contents input from the operating unit 260. By doing that, the host control unit 211 generates the control signals needed to control the printer 300 according to input from the operator.

Also, the printer driver 210 is equipped with an image processing unit 213 that implements image processing on image data received from an external device, and generates printing data. In specific terms, image processing such as resolution conversion processing, color conversion processing, halftone processing and the like are performed.

Then, control signals generated by the host control unit 211 or printing data generated by the image processing unit 213 are transferred via a transfer control unit 220 to a printer control unit 400 provided within the main unit case 1 of the printer 300. With this transfer control unit 220, bidirectional serial communication is possible with the printer control unit 400, and control signals or printing data are transferred to the printer control unit 400, and the reply signal to that is received from the printer control unit 400 and sent to the host control unit 211.

The printer control unit 400 is equipped with a head controller 410 and a mechanism controller 420. The head controller 410 is in charge of the function of controlling the recording heads 34 based on the printing data sent from the printer driver 210. In specific terms, the head controller 410 controls the ink eject from the nozzles 35 of the recording heads 34 based on the printing data. At that time, the timing of ejecting the ink from the nozzles 35 is controlled based on the movement of the carriage 32 in the X axis direction. Specifically, a linear encoder E32 for detecting the X axis direction position of the carriage 32 is provided inside the printing chamber 3. Then, the head controller 410 ejects ink from the nozzles 35 at the timing according to the movement of the carriage 32 in the X axis direction by referencing the output of the linear encoder E32.

Meanwhile, the mechanism controller 420 is mainly in charge of the function of controlling the driving of the intermittent conveyance of the sheet S and of the carriage 32. In specific terms, the mechanism controller 420 controls the conveyance motor Ms that drives the sheet conveyor system constituted by the outlet unit 2, rollers 71 to 77, and the rewind unit 5 based on the output of the encoder Emc that detects the rotation of the conveyor motor Ms, and executes intermittent conveyance of the sheet S. Also, by controlling the first CR motor Mx, the mechanism controller 420 executes movements of the carriage 32 in the X axis direction for the main scan, and also, by controlling the second CR motor Mx, executes movement of the carriage 32 in the Y axis direction for the sub scan.

Then, by suitably executing control of the head controller 410 and the mechanism controller 420 while having them synchronized, a number of passes according to the resolution is executed on the intermittently conveyed sheet S, and one frame of printing is executed. By doing this, one frame of an image having the desired resolution is printed on the sheet S.

Also, the mechanism controller 420 can execute various controls in addition to the aforementioned controls for print processing. In specific terms, the mechanism controller 420 detects whether the power switch SW is on or off, and when the power switch SW is on, it executes activation processing of each unit of the printer 300. Also, the mechanism controller 420 executes temperature control such as by doing feedback control of the heater 38 based on the output of the temperature sensor S30 that detects the temperature of the top surface of the platen 30, and doing feedback control of the drying unit 4 based on the output of the temperature sensor S4 that detects the temperature inside the drying unit 4. Furthermore, the mechanism controller 420 is able to execute various operations such as controlling the suction unit 37 to adjust the negative pressure generated in the vacuum holes of the platen 30, and controlling the maintenance unit 9 to execute designated maintenance. In particular, as is described later, the mechanism controller 420 of this embodiment is also in charge of controlling a corona treater movement mechanism M80 that moves the corona treater 80 in the X axis direction, or an earth roller movement mechanism M841 that moves the earth roller 841 in the X axis direction.

The above is a summary of the electrical constitution that the printing system of FIG. 1 is equipped with. Following, we will give a detailed description of the printing operation executed with this embodiment. As described above, the printer 300 is provided with a corona treatment unit 8 that executes surface modification processing (corona treatment) on the sheet S. Then, with the printing operation executed by the printer 300, surface modification processing is suitably executed on the sheet S. In light of that, following, we will describe the operation of the corona treatment unit (FIG. 4), and then describe the printing operation executed by the printer 300 (FIG. 5).

Figure 4:
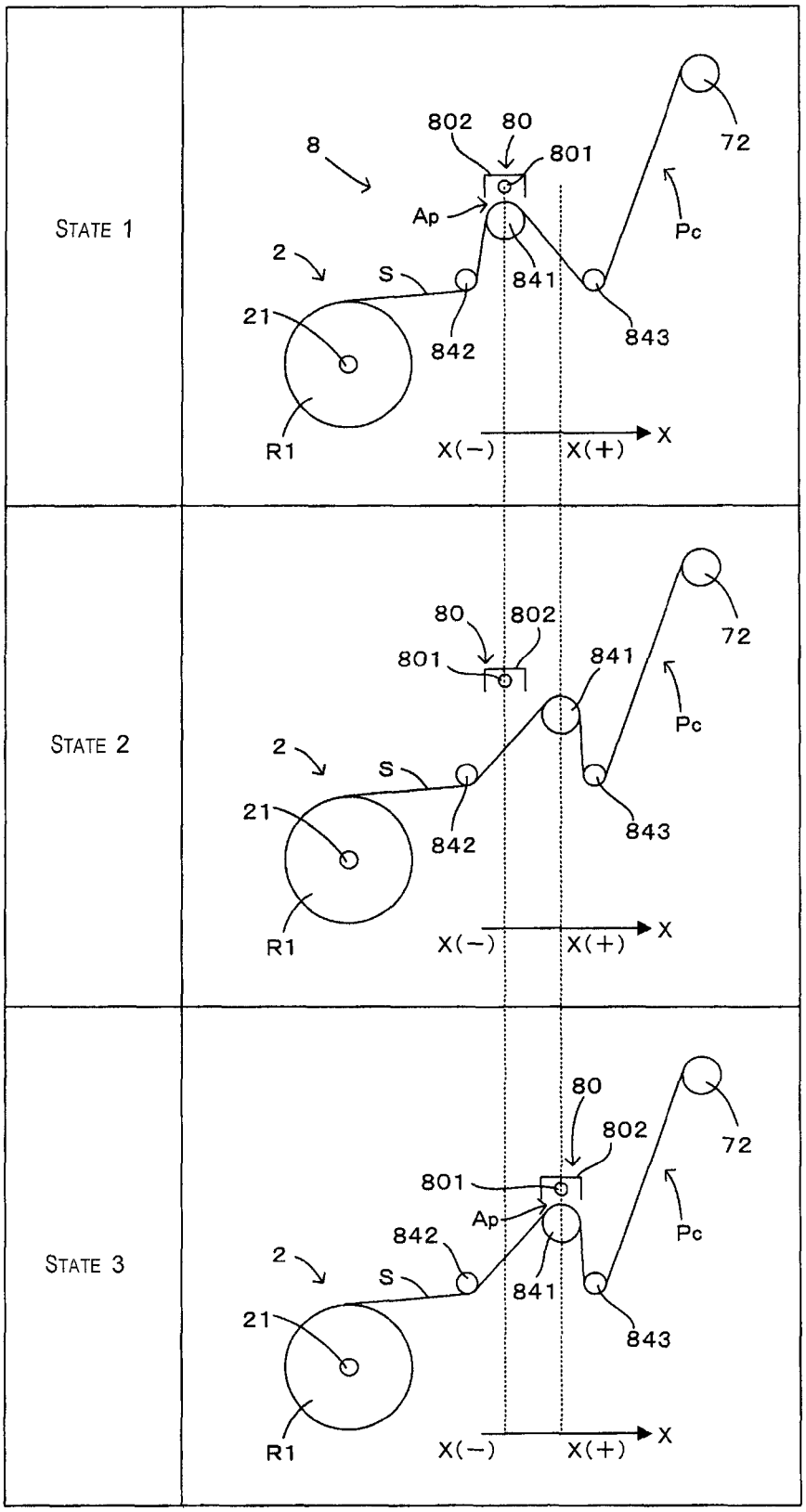
FIG. 4 is a side view typically showing the operation of the corona treatment unit.

FIG. 4 is a side view typically showing the operation of the corona treatment unit. With this embodiment, the corona treater 80 and the earth roller 841 are respectively constituted to be able to move freely in the X axis direction, and in specific terms, they are able to move freely between the X axis direction positive side position X (+) and negative side X (−). Then, the corona treatment unit 8 is able to be in any of the states 1 through 3 shown in FIG. 4 according to necessity. With state 1, both the corona treater 80 and the earth roller 841 exist at position X (−), and are mutually close to each other and form a processing position Ap at position X (−). In state 2, the corona treater 80 exists at position X (−), and the earth roller 841 exists at position X (+). In this state, the sheet S is separated in the X axis position direction in relation to the corona treater 80, and a processing position Ap is not formed. In state 3, both the corona treater 80 and the earth roller 841 exist at position X (+), and are mutually close and a processing position Ap is formed at position X (+). In this way, with this embodiment, the state of the corona treater 80 is made to transition from state 1 to state 3, so it is possible to move the processing position Ap in the X axis positive direction, and as a result, it is possible to move the processing position Ap to the downstream side of the conveyance path Pc in relation to the sheet S (processing position movement processing).

Figure 5:
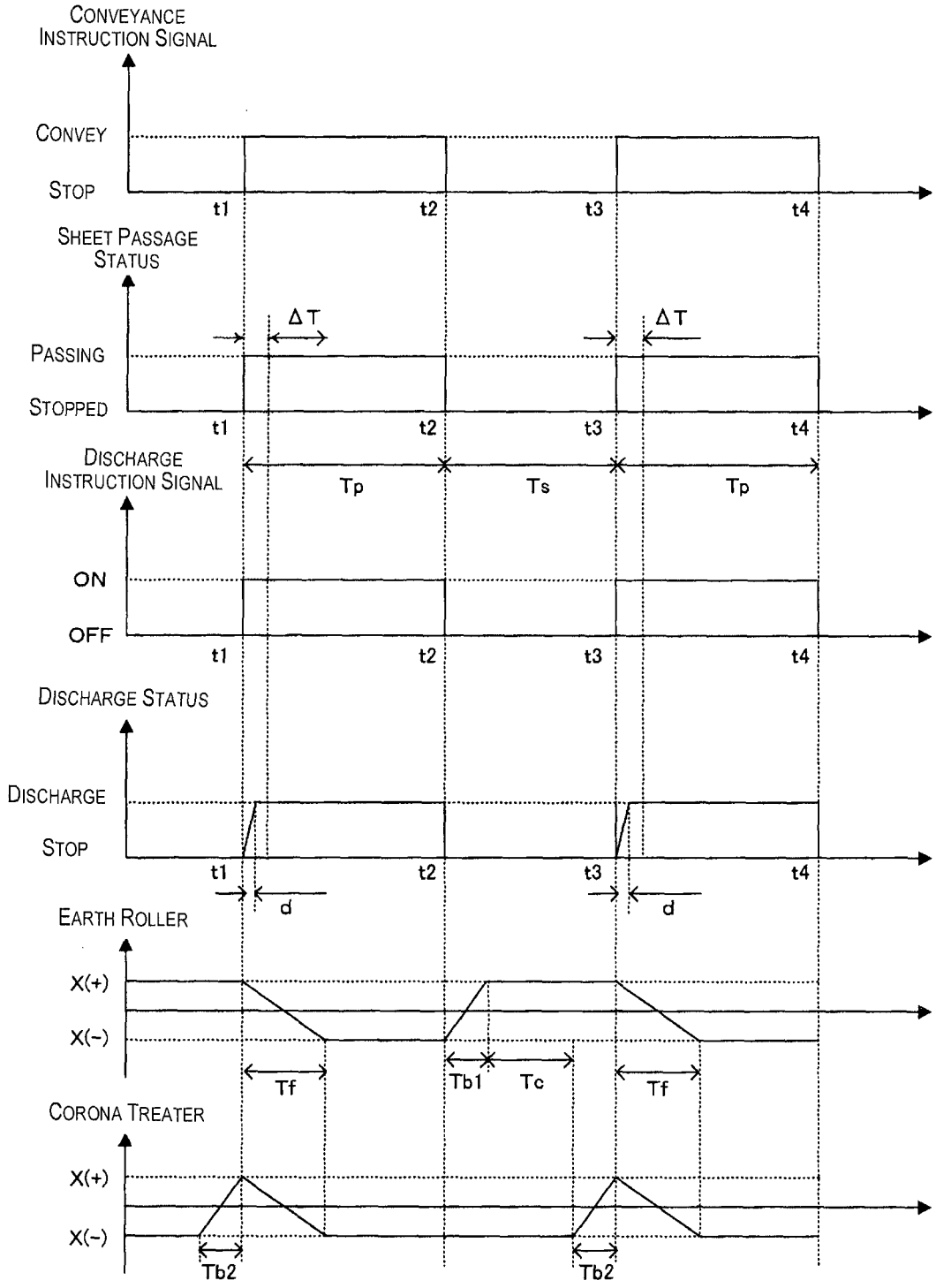
FIG. 5 is a timing chart showing an example of the printing operation.

FIG. 5 is a timing chart showing an example of the printing operation. With the description below, to show the rotation direction of the roller 72 and the outlet shaft 21, the expressions "forward" and "backward" are used. At that time, "forward" indicates the rotation direction that conveys the sheet S from the upstream side to the downstream side of the conveyance path Pc, and "backward" indicates the rotation direction that conveys the sheet S from the downstream side to the upstream side of the conveyance path Pc.

As described above, with the printer 300, printing is executed on the surface of the sheet S that is stopped on the top surface of the platen 30 while the sheet S is intermittently conveyed on the top surface of the platen 30. In light of that, with the printing operation, the conveyance instructions for controlling the intermittent conveyance of the sheet S are output from the mechanism controller 420. In specific terms, with the example shown in FIG. 5, while conveyance instructions are output between times t1 and t2 and between times t3 and t4, conveyance instructions are not output between times t2 and t3 ("conveyance instructions" graph in FIG. 5).

Then, while conveyance instructions are being output, the roller 72 (drive roller) rotates forward (clockwise in FIG. 1), and conveys the sheet S from the upstream side of the conveyance path Pc to the platen 30. Also, the outlet shaft 21 also rotates forward (clockwise in FIG. 1) according to the rotation of the roller 72, and conveys the sheet S to the roller 72 via the corona treatment unit 8 from the upstream side of the conveyance path Pc. By doing this, the sheet S conveyed by the roller 72 to the platen 30 is let out from the roll R1 of the outlet shaft 21 and supplied to the roller 72. Meanwhile, when conveyance instructions are not output, the roller 72 and the outlet shaft 21 stop rotating, and stop conveying the sheet S to the platen 30.

Also, the sheet S intermittently conveyed in this way is intermittently passed through the processing position Ap of the corona treatment unit 8 ("sheet passage state" graph in FIG. 5). In specific terms, with the example shown in FIG. 5, between times t1 and t2 and between times t3 and t4, the sheet S is stopped at the processing position Ap. In other words, while the sheet S passes through the processing position Ap toward the downstream side of the conveyance path Pc during the passage time Tp (between times t1 and t2 and between times t3 and t4), the sheet S is stopped at the processing position Ap during the stop time Ts (between times t2 and t3) (conveyance step).

Then, the mechanism controller 420 gives discharge instructions for controlling whether the corona treater 80 is on or off to the discharge bias generator 84 according to the timing at which the sheet S passes through the processing position Ap. In specific terms, while the mechanism controller 420 outputs discharge instructions during the sheet S passage time Tp to the discharge bias generator 84, discharge instructions are not output during the sheet S stop period Ts. Then, the discharge bias generator 84 receives discharge bias output according to the discharge instructions, and the corona treater 80 executes corona discharge.

As shown in the "discharge state" graph in FIG. 5, with the corona discharge of the corona treater 80, the discharge starts after a prescribed delay time d has elapsed from the start of the sheet S passage time Tp, and ends together with the ending of the sheet S passage time Tp. In this way, a time difference d occurs from the start of the sheet S passage time Tp until the start of the corona discharge. Therefore, surface modification processing is not executed on the sheet S that passes through the processing position Ap during the delay time d from the start of the sheet S passage time Tp. Then, surface modification processing (corona treatment) is executed only on the sheet S that has passed through the processing position Ap during the time from the start of the corona discharge until the sheet S passage time Tp ends.

In light of that, with this embodiment, regardless of the delay of the start of the corona discharge, to keep the area for which there is insufficient surface modification processing small, the mechanism controller 420 controls the movement mechanisms M80 and M841, and executes processing position movement adjustment as appropriate. The specifics of this are as follows.

At the starting point of the stop time Ts (specifically, the end time of the passage time Tp), both the corona treater 80 and the earth roller 841 exist at position X (−), and the corona treatment unit 8 is in state 1. Then, during the sheet S stop time Ts, the corona treatment unit 8 transitions from this state 1 through state 2 to state 3. Specifically, a prescribed time Tb1 of the sheet S stop time Ts (with the example in FIG. 5, prescribed time Tb1 from the start of the stop time Ts) is applied, and the earth roller 841 moves from position X (−) to position X (+). In this way, the corona treatment unit 8 transitions to state 2 (separation operation) with the distance between the sheet S and the corona treater 80 more separated than with state 1. Furthermore, at the sheet S stop time Ts, when this transition to state 2 is completed and a time Tc elapses, a prescribed time Tb2 (with the example in FIG. 5, prescribed time Tb2 before the end of the stop time Ts) is applied, and the corona treater 80 moves from position X (−) to position (+) (state 3). In this way, at stop time Ts, the processing position Ap moves by a prescribed movement volume ΔS to the downstream side of the conveyance path in relation to the sheet S.

By doing this, before the surface modification processing on the sheet S executed at the passage time Tp (t3 to t4) following this stop time Ts (t2 to t3), the sheet S is moved by a movement volume ΔS to the upstream side of the conveyance path Pc in relation to the processing position Ap. As a result, a portion of the sheet S (the part correlating to the movement volume ΔS) that underwent surface modification processing at the passage time Tp (t1 to t2) before this stop time Ts (t2 to t3) moves to the upstream side of the conveyance path Pc in relation to the processing position Ap. Therefore, at the subsequently executed passage time Tp (t3 to t4), for the prescribed time ΔT from the start of the passage time T, the sheet S that already underwent surface modification processing passes through the processing position Ap. Thus, even if the start of the corona discharge from the passage time Tp is delayed by the delay time d, it is possible to suppress the volume of the sheet S for which the surface modification processing is insufficient. Also, even with this embodiment, if the movement volume S of the processing position movement process is set so that the time ΔT is longer than the delay time d, it is possible to almost completely suppress the occurrence of the sheet S for which surface modification processing is insufficient.

This kind of processing position movement processing is executed at each stop time Ts for which the sheet S stops at the processing position Ap. Therefore, when the processing position Ap is moved to the position X (+) with the processing position movement process, in preparation for the next processing position movement process, the processing position Ap must be returned to the position X (−). In light of that, with this embodiment, a prescribed time Tf of the passage time Tp in which the sheet S passes through the processing position Ap (with the example in FIG. 5, prescribed time Tf from the start of the passage time Tp) is applied, and by moving the corona treater 80 and the earth roller 841 left facing opposite each other from position X (+) to position X (−), the processing position Ap returns from X (+) to position X (−), and prepares for the next processing position movement process to be executed.

As described above, with this embodiment, the sheet S intermittently passes through the processing position Ap, and also, during the passage time Tp in which the sheet S passes through the processing position Ap, surface modification processing is executed by the corona treater 80 on the sheet S that passes through the processing position Ap. Also, with this embodiment, a constitution is provided by which the corona treater and the sheet S are mutually placed close together and separated. In specific terms, in the passage time Tp, the sheet S that passes through the processing position Ap and the corona treater 80 are put close together, making it possible to execute surface modification processing on the sheet S passing through the processing position Ap. Meanwhile, when the passage time Tp ends, the separation operation by which the sheet S and the corona treater 80 are separated is executed. Specifically, when the passage time Tp ends and intermittent conveyance of the sheet S to the processing position Ap stops, the sheet S and the corona treater 80 are separated. Therefore, conduction of heat to the sheet S from the corona treater 80 which generates heat along with execution of the surface modification processing is inhibited. As a result, degradation of the sheet S due to the heat of the corona treater 80 is suppressed, and it becomes possible to realize high quality image recording.

In particular with this embodiment, during the prescribed time Tc, the corona treater 80 is separated from the sheet S. Therefore, at a location separated by a certain degree from the sheet S, it is possible to reliably cool the corona treater 80 by applying a prescribed time Tc. Then, after cooling of the corona treater 80 is performed in this way, the corona treater 80 is moved up to a position facing opposite the earth roller 841, and is placed near the sheet S. By doing this, it is possible to more reliably suppress degradation of the sheet S due to heat from the corona heater 80.

As described above, the printer 300 correlates to the "image recording device" of the present invention, the sheet S correlates to the "recording medium" of the present invention, the conveyance path Pc correlates to the "conveyance path" of the present invention, the ink correlates to the "liquid" of the present invention, the platen 30 correlates to the "support member" of the present invention, the recording head 34 correlates to the "recording head" of the present invention, the sheet conveyance system constituted by the outlet unit 2, the rollers 71 to 77, and the rewind unit 5 correlates to the "conveyor unit" of the present invention, the corona treater 80 and the discharge bias generator 84 work jointly to function as the "surface modifying apparatus," the processing position Ap correlates to the "processing position" of the present invention, and the earth roller 841, the corona treater movement mechanism M80, and the earth roller movement mechanism M841 work jointly to function as the "movement mechanism" of the present invention.

The present invention is not limited to the embodiment noted above, and various modifications can be made to the item described above as long as it does not stray from its key points. For example, with the embodiment noted above, the separation operation of separating the corona treater 80 and the sheet S was executed by moving the earth roller 841 from the position X (−) to the position X (+). However, it is also possible to execute the separation operation by moving the corona treater 80 from the position X (−) to the position X (+).

Also, with the embodiment noted above, the separation operation was executed within the processing position movement process by which the processing position Ap was moved relative to the sheet S. However, it is not absolutely necessary to execute this kind of processing position movement process, and it is also possible to constitute this simply so that only the separation operation is performed. In light of that, it is also possible to execute the separation operation by separating the corona treater 80 from the earth roller 841 while having the earth roller 841 provided in a fixed mode and providing the corona treater 80 so as to be able to come close to and separate in relation to the earth roller 841.

Also, various modifications are possible for the constitution of the conveyance system for conveying the sheet S as well. In light of that, for example it is also possible to constitute this so that a raising and lowering roller such as that in Japanese Laid-Open Patent Application Publication No. 2009-292129 is provided between the corona processing sheet 8 and the roller 72, and to have the sheet S of the volume supplied to the platen 30 by the roller 72 with one conveyance be let out in advance between the corona treatment unit 8 and the roller 72 and stored (buffered). In this case, as shown in FIG. 5, it is not absolutely necessary to match the output timing of the conveyance instructions with the timing of the sheet S passing through the processing position Ap. Therefore, it is possible to execute at differing timings and speeds the supplying of the sheet S to the platen 30 according to the conveyance instructions, and the passing of the sheet S to the processing position Ap. By doing this, it is possible to respectively execute at appropriate timings the operation of intermittently conveying the sheet S to the platen 30 and the operation of intermittently passing the sheet S to the processing position Ap.

Also, with the embodiment noted above, surface modification processing was executed using corona treatment. However, it is also possible to constitute this so as to execute surface modification processing using a method other than corona treatment, such as plasma processing, for example.

Also, with the embodiment noted above, we described a case of applying the present invention to an inkjet printer using the piezo method. However, it goes without saying that the present invention can also be applied to an inkjet printer using a thermal method.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a support member configured and arranged to support a recording medium conveyed along a conveyance path;

a recording head configured and arranged to eject a liquid on the recording medium while stopped above the support member to record an image;

a conveyor unit configured and arranged to intermittently convey the recording medium toward the support member along the conveyance path, and to intermittently pass the recording medium through a processing position disposed on an upstream side of the supporting member with respect to the conveyance path by intermittently conveying the recording medium to the processing position along the conveyance path;

a surface modifying apparatus configured and arranged to, during a passage time in which the recording medium passes through the processing position, execute surface modification processing on the recording medium passing through the processing position, and to emit heat along with execution of the surface modification process; and a movement mechanism configured and arranged to place the recording medium passing through the processing position near the surface modifying apparatus during the processing time, and to separate the recording medium and the surface modifying apparatus when the passage time ends, the movement mechanism including a surface modifying apparatus movement mechanism configured and arranged to move the surface modifying apparatus in a direction of conveying the recording medium.

2. The image recording device according to claim 1, wherein the movement mechanism has a winding roller configured and arranged to wind up the recording medium from an opposite side of the surface modifying apparatus across the recording medium, and the movement mechanism is configured and arranged to place the recording medium near the surface modifying apparatus by having the winding roller face opposite the surface modifying apparatus at the processing position during the processing time, and to execute a separation operation by separating the winding roller from the surface modifying apparatus when the passage time ends.

3. The image recording device according to claim 2, wherein the winding roller is further configured and arranged to move in the direction of conveying the recording medium.

4. The image recording device according to claim 1, wherein the conveyor unit is configured to execute an operation of performing intermittent conveyance of the recording medium to the support member and an operation of intermittently passing the recording medium through the processing position at different timings.

5. An image recording method for ejecting a liquid on a recording medium while stopped above a support member to record an image while the recording medium is being conveyed along a conveyance path, the image recording method comprising:

intermittently conveying the recording medium toward the support member along the conveyance path, and intermittently passing the recording medium through a processing position disposed on an upstream side of the supporting member with respect to the conveyance path by intermittently conveying the recording medium to the processing position along the conveyance path; and during a passage time in which the recording medium passes through the processing position, executing surface modification processing on the recording medium passing through the processing position using a surface modifying apparatus that emits heat along with execution of the surface modification processing, the executing of the surface modification processing including placing the recording medium passing through the processing position near the surface modifying apparatus during the processing time, and executing a separation operation which separates the recording medium and the surface modifying apparatus when the passage time ends, and the separation operation including moving the surface modifying apparatus in a direction of conveying the recording medium.

* * * * *